US005957404A

United States Patent [19]

Frampton et al.

[11] Patent Number: 5,957,404

[45] Date of Patent: Sep. 28, 1999

[54] IRONING ROLL WITH CAM FOR FOLLOWING COIL/STRIP TANGENT POINT

[75] Inventors: Andrew Frampton, Allison Park; William C. Kramer, Pittsburgh, both of Pa.

[73] Assignee: Kvaerner Metals, Pittsburgh, Pa.

[21] Appl. No.: 09/062,406

[22] Filed: Apr. 20, 1998

[51] Int. Cl.[6] ..... B65H 18/26

[52] U.S. Cl. ..... 242/547

[58] Field of Search ..... 242/547, 541.6, 242/541.7, 534, 566, 548

[56] References Cited

U.S. PATENT DOCUMENTS

| | | | |
|---|---|---|---|
| 3,446,449 | 5/1969 | Waychoff | 242/547 |
| 4,343,440 | 8/1982 | Engl | 242/547 |
| 4,404,831 | 9/1983 | Hild et al. | 242/566 |
| 4,736,605 | 4/1988 | Klockner et al. | 242/547 |
| 4,964,587 | 10/1990 | Oki et al. | 242/547 |
| 5,035,373 | 7/1991 | Perrigo | 242/547 |
| 5,054,707 | 10/1991 | Olson | 242/547 |
| 5,275,345 | 1/1994 | Stahl et al. | 242/547 |

FOREIGN PATENT DOCUMENTS

| | | | |
|---|---|---|---|
| 360112556 | 6/1985 | Japan | 242/547 |
| 361012559 | 1/1986 | Japan | 242/547 |

*Primary Examiner*—John M. Jillions

*Attorney, Agent, or Firm*—Armstrong, Westerman, Hattori, McLeland & Naughton

[57] ABSTRACT

An apparatus and method for pressing a rotatable ironing roll against an outermost wrap of strip material being coiled with substantially constant force and at a minimum constant distance from the tangent point of entry of the strip onto the coil, comprising an ironing roll support linearly and pivotally movable with respect to the coil, a sensor to determine a position of the ironing roll and to determine a corresponding desired roll pressure, and a cam connected to the ironing roll support and adapted to cause the ironing roll to follow a curved locus of the tangent point as the coil diameter increases.

11 Claims, 2 Drawing Sheets

IRONING ROLL WITH CAM FOR FOLLOWING COIL/STRIP TANGENT POINT

BACKGROUND

1. Field of the Invention

This invention relates to apparatus and methods for pressing or ironing a strip material, such as metal foil, as it is being wound onto the mandrel of a take-up reel and, more particularly, to such apparatus and methods wherein a constant force is applied to the growing coil by an ironing roll, and a constant distance is maintained between the point of contact of the ironing roll with the coil and the tangent point where the strip is wound onto the mandrel or coil, to avoid entrainment of air between overlapping wraps of the strip.

2. Description of Prior Art

The pressing or ironing of sheet or strip material by pressing a rotatable roll against a mandrel onto which the material is being wound is old in the art. It also is known to effect a constant pressing force of the roll against the mandrel or growing coil. For example, U.S. Pat. No. 4,404,831 provides a pressurizable hydraulic cylinder, concentrically surrounded by a pneumatic cylinder providing a constant spring characteristic for the compressed air in that cylinder. Rate of movement of the pressing roll relative to the mandrel or coil is controlled by controlling the velocity of fluid flow into the hydraulic cylinder, and the pressing force of the roll against the mandrel or coil is controlled by regulating the pressure of the hydraulic fluid.

In U.S. Pat. No. 4,736,605, an ironing roll pressure and position control mechanism is designed to avoid scrap loss of initially wound wraps due to the "hump" caused by the leading edge of the coiled strip. This is done by changing the pressure of the ironing roll against the coil as the "hump" on the rotating coil comes under the ironing roll, that is, the roll pressure is changed as a function of the position of the leading edge of the strip relative to the roll.

U.S. Pat. No. 4,964,587 discloses an apparatus for facilitating wrapping a strip of material on a mandrel, and comprises a first frame having a pivoted end and another end attached to a second, pivoted frame carrying a roller for pressing against the strip being wound and a curved guide plate for directing the strip onto the mandrel.

U.S. Pat. No. 5,275,345 relates to an ironing roll apparatus for winding metal foil and comprising a fluid pressure cylinder for moving the roll toward and away from the growing coil, and a pair of fluid pressure cylinders disposed at either end of the coil and actuable to adjust the roll at an angle to the width of the coil in order to correct improper coiling due to strip defects.

In the winding of very thin strip materials, such as aluminum foils and strip, e.g. of thicknesses on the order of 0.0003–0.030 inch, onto a mandrel, there is a tendency for the strip to flutter with accompanying air entrainment between the coil wraps which can cause defects in the coil during winding. This condition is to be avoided if possible. The above-mentioned U.S. Pat. No. 5,275,345 mentions this phenomenon and characterizes pressing or ironing rolls generally as functioning to reduce this air entrainment tendency by squeezing a portion of the air from between the wraps.

SUMMARY OF THE INVENTION

We have found that conventional ironing roll arrangements are relatively ineffective in preventing air entrainment in the winding of thin metal foils, which is due, in large part, to the substantial displacement, as the coil is built up, of the ironing roll relative to the tangent point where the strip is wound onto the mandrel or the growing coil.

The present invention provides means to maintain, not only a constant force of an ironing roll against a growing coil being built up on a rotating mandrel, but also provides means to maintain a constant, minimum distance between the point of contact of the ironing roll and coil and the tangent point of entry of the strip onto the mandrel, thereby effectively minimizing the amount of air entrained between the coil wraps as they are formed. To this end, there is provided a pivoted frame carrying a guide tube having an ironing roll support mounted on a free end of the guide tube, and a fluid pressure cylinder having a piston rod thereof attached to and driving the roll support element and associated roll. A cam arrangement is connected to another end of the guide tube and, by following a cam track on withdrawal of the guide tube away from the coil as it builds up, maintaining a constant distance between the ironing roll and tangent point where the moving strip is laid onto the mandrel.

DESCRIPTION OF PREFERRED EMBODIMENTS

Figure 1:
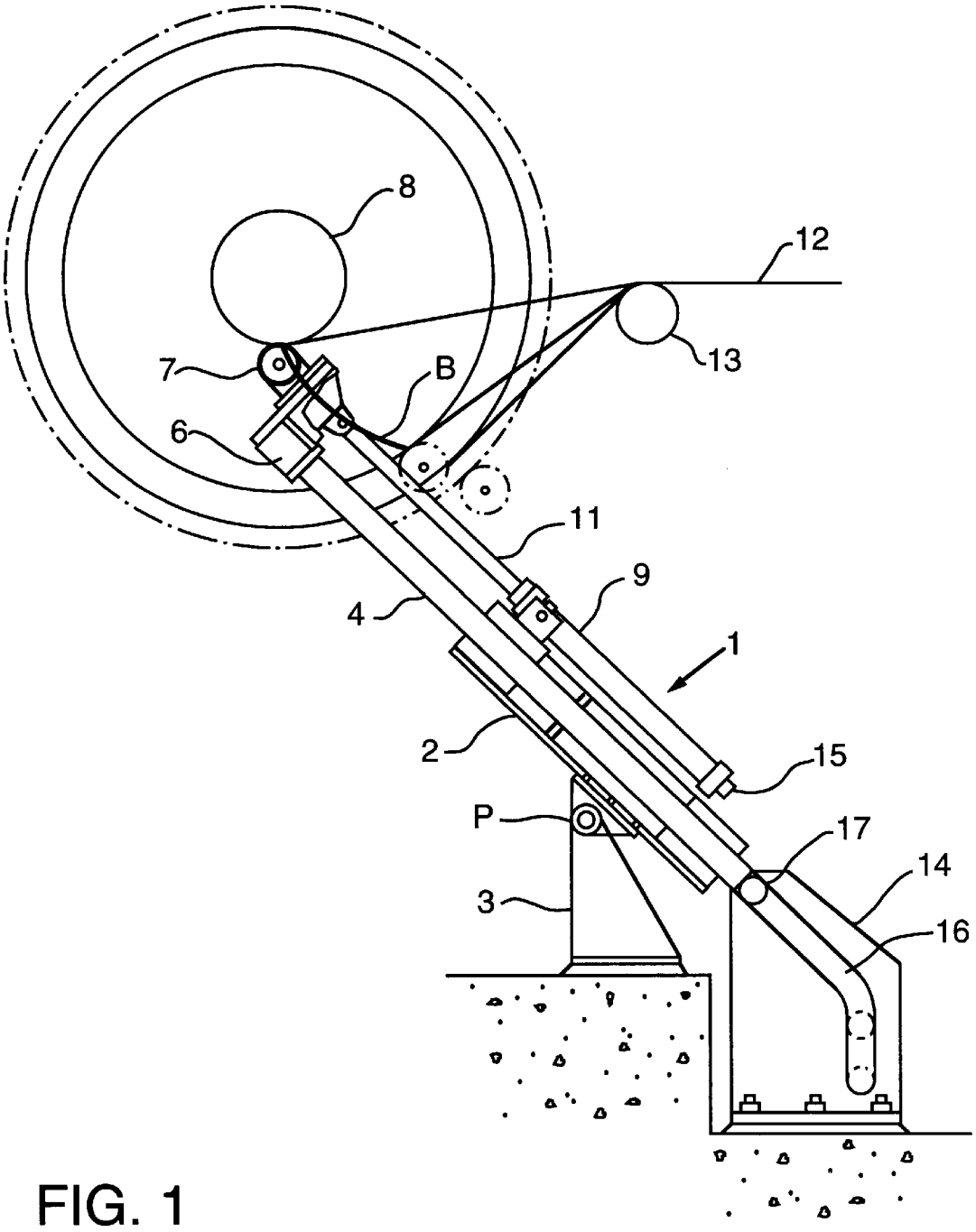
FIG. 1 is a side elevational view of the ironing roll mechanism of the invention.

In FIG. 1, an ironing roll assembly, denoted generally by the numeral 1, comprises an elongated frame 2 pivotally mounted at P on a stanchion 3. A guide tube 4 is slidably mounted on the frame 2 and, at one end, carries a roll support 6 on which is rotatably mounted an ironing roll 7 for bearing against a mandrel 8 of a winding reel (not shown). Also mounted on the frame 2 is a fluid pressure cylinder 9 having a piston rod 11 connected to the roll support 6 for forcing the ironing roll 7 against the mandrel 8 or coil of strip 12 as it is wound onto the mandrel after passing over a deflection roll 13. Cylinder 9 has a position transducer mounted internally of the cylinder on an end of piston rod 11 and is provided with an electrical lead line 15 extending outside the cylinder. In FIG. 1, the ironing roll 7 is shown in contact with the mandrel 8 in the maximum extended position of the rod 11 of the cylinder 9 and as close as possible to the tangent point of the entering strip 12.

As also shown in FIG. 1, as the coil of strip 12 builds up on the mandrel 8, the increasing diameter of the coil causes the tangent point where the entering strip is laid on the growing coil to move outwardly, away from the mandrel. The locus of the tangent point in such movement is shown by a path B in dotted line FIG. 1.

Conventional ironing rolls become progressively more distant from the strip tangent point as the coil builds up in diameter, thus affording greater opportunity for entrainment of air between the coil wraps in the increasing spacing between the contact point of the roll and the coil and the strip tangent point. In order to prevent such occurrence, and to permit ironing roll 7 to effectively track the locus path B by linear movement of the roll relative to the coil and by pivoting of the frame about the pivot point P, and thereby to maintain a constant distance between the tangent point and the contact point of roll 7 with the growing coil, there is provided a plate 14 having a cam track 16 in which there is slidably movable a cam roll 17 connected to an outer end of the guide tube 4. Cam track 16 is so shaped that the cam roll 17 and associated guide tube 4 and ironing roll 7 move parallel to and at a constant distance from the locus B of the moving tangent point as the coil of strip is built up. This constant distance is as small as practical and may be, for example, about 35–70 mm, in order to prevent air entrainment between the coil wraps and also, by application, through the roll force, of interlap friction substantially at the tangent point, to prevent weaving of the entering coil from side to side.

Figure 2:
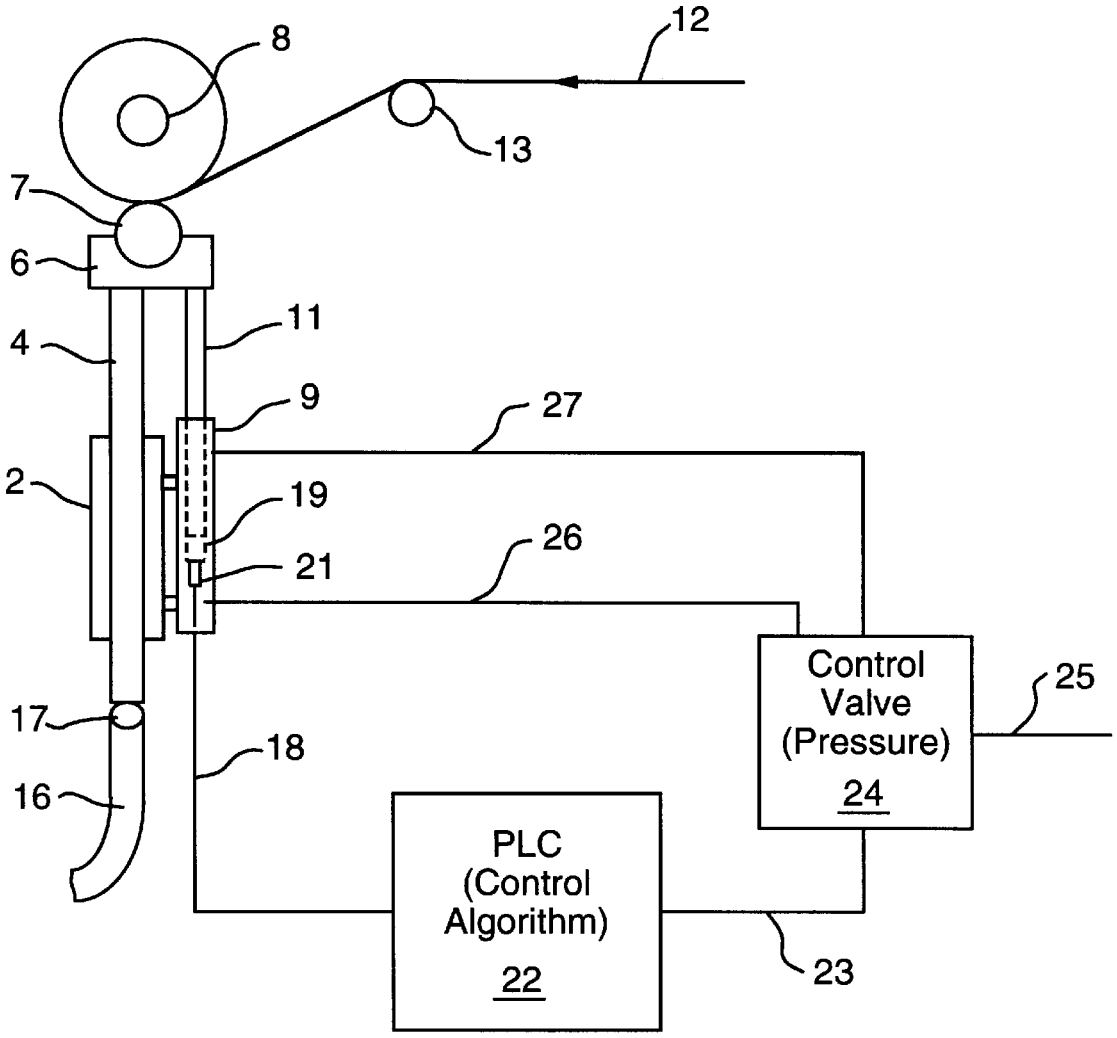
FIG. 2 is a schematic illustration of the system for controlling the force and movement of the ironing roll relative to a coil of strip being wound on a mandrel.

The control system for operation of the ironing roll assembly of the invention is shown schematically in FIG. 2 which shows a double-acting piston 19 slidably movable with the piston rod 11 within the cylinder 9, and the position transducer 21 mounted on an end of rod 11 and having electrical lead 18 extending outside the cylinder 9 and connected to a programmable logic computer (PLC) 22 and through which lead 18 a position reference signal is input into PLC 22. By means of a control algorithm, the PLC computes a desired pressure signal which is input, through line 23, to a pressure control valve 24, connected via line 25 to a fluid pressure source, and which valve controls the fluid pressure in cylinder 9 through line 26 to one side of the piston 21 to maintain a constant force of the ironing roll on the coil by moving the piston rod 11 and associated ironing roll 7 toward the coil to increase the ironing force on the coil, or through line 27 to the other side of the piston 21 to move the piston rod and ironing roll away from the coil to decrease the ironing force on the coil.

In calculating the control equation relating the actuating cylinder fluid pressure to the changing coil diameter, the control algorithm takes into account a number of variables: the ironing force $F_i$ acting normal to the ironing roll surface; the fluid pressure P applied to the blank end (the end outwardly of the coil) of the actuating cylinder; $F_{cyl}$, the cylinder force developed; $D_{cyl}$, the distance from pivot point P to the centerline of the cylinder, measured perpendicularly; $D_i$, the torque arm of the ironing force about the pivot point P; $W_1$, the weight of the sliding components of the ironing roll assembly; $D_{wi}$, the torque arm of $W_1$ about the pivot point P; $W_2$, the weight of the pivoting components of the ironing roll assembly; $D_{w2}$, the torque arm of $W_2$ about pivot point P; N, the normal force applied to the guide tube 4 by a guide bushing supporting the inwardly extending end of the guide tube; $D_C$, the couple arm, that is, the distance between the normal forces N, measured perpendicularly; $\mu$, the coefficient of friction between the aforesaid bushing and the guide tube; $\sigma_R$ the angle formed by the vertical centerline of the mandrel 8 and the mandrel/ironing roll centerline; $v_F$, the angle formed by the centerline of the main frame 2 and the horizontal plane; $F_{CAM}$, the cam roll reaction force perpendicular to the cam roll contact surface; $D_\mu$, the friction force ($\mu \times N$) torque arm about the pivot point P; $F_{CH}$, the horizontal component of the cam roll reaction force $F_{CAM}$; $D_{CH}$, the torque arm of $F_{CH}$ about the pivot point P; $F_{CV}$, the vertical component of the cam roll reaction force $F_{CAM}$; $D_{CV}$ the torque arm $F_{CV}$ about the pivot point P; $R_{PH}$, the horizontal reaction force at the pivot point P, and $R_{PV}$, the vertical reaction force at the pivot point P. Using these variables, development of the algorithm using well-known principles of rigid body mechanics are applied, and by solving for static equilibrium in two dimensions, an equation is developed which is used to control fluid pressure in the actuating cylinder as the coil builds up in diameter. This controlled pressure provides a near-constant ironing force at a predetermined distance behind the strip tangent point. Actual values for at least some of these variables will change with different ironing roll assembly designs and dimensions for particular installations within the scope of the invention, and the corresponding algorithm will change accordingly.

The invention as above described is particularly useful in conjunction with underwound coil installations in which it normally is not possible to install a more space-consuming pivoting or swinging arm arrangement for tracking the locus of the tangent point of the strip as the coil builds up.

What is claimed is:

1. An ironing roll assembly, comprising an elongated pivoted frame, a guide tube slidably mounted on the frame and having one end thereof connected to an ironing roll support, an ironing roll rotatably mounted on the roll support, means, as a coil of material increases in diameter with continued coiling, to maintain a constant pressure of the ironing roll against coiled strip material and a constant distance between a point of contact of the ironing roll with the coil and a tangent point of the coil and entering strip material being coiled and to prevent weaving of the entering strip material.

2. An assembly according to claim 1, wherein the means to maintain constant pressure of the ironing roll against the coil comprises a fluid pressure cylinder mounted on the frame and having a double-acting piston slidably movable within the cylinder and connected to a piston rod having one end thereof connected to the ironing roll support, means to sense the position of the piston rod and connected ironing roll and to generate a position reference signal, computer means responsive to said position signal to calculate a desired pressure signal of the ironing roll against the coil, and means responsive to said desired pressure signal to control the pressure in the cylinder to effect a desired constant roll pressure.

3. An assembly according to claim 2, wherein the pressure control means comprises a pressure control valve connected to a source of pressurized fluid and to each side of the double-acting piston in the fluid pressure cylinder whereby on actuation of the control valve the piston and associated ironing roll are caused to move toward or away from the coil to increase or to decrease the pressure of the ironing roll on the coil and maintain such pressure at a predetermined constant value.

4. An assembly according to claim 3, wherein the means to maintain a constant roll contact/tangent point distance comprises a cam roll mounted on another end of the guide tube and slidably movable in a cam track shaped to provide, with a linear movement of the guide tube and a pivoting movement of the frame, a movement of the ironing roll relative to the coil in a curved path similar to and adjacent a path of movement of the tangent point during coil build up.

5. An assembly according to claim 4, wherein the coil is an underwound coil.

6. An assembly according to claim 5, wherein the strip material is aluminum foil or strip.

7. An assembly according to claim 6, wherein the aluminum foil or strip has a thickness from about 0.0003–0.030 inch.

8. An apparatus for ironing a material during coiling thereof, comprising a rotatable ironing roll, ironing roll support means linearly movable toward and away from a coil of the material during coiling and pivotable with respect to the direction of such linear movement of the ironing roll, means to control the pressure of the roll against the coil at a constant value as the coil diameter changes, linear movement means and pivoting movement means to change the position of the ironing roll as the coil diameter changes, and cam means connected to the ironing roll support means and moving in a cam track to cause the ironing roll adjacently to follow a locus of travel of the tangent point of entry of the material onto the coil as the coil diameter changes.

9. An apparatus according to claim 8, wherein the coil is an underwound coil of aluminum foil.

10. A method of reducing air entrainment in the coiling of thin strip material comprising exerting a substantially constant pressure on an outer wrap of the coiled material by means of a linearly and pivotally movable rotatable ironing roll disposed against an outermost coil wrap at a substantially constant minimum distance from the tangent point where the strip is laid on the coil, such means maintaining the constant minimum distance by moving a cam attached to an ironing roll support means, in a cam track shaped to cause the ironing roll to follow a curved locus of travel of the tangent point in response to increasing diameter of the coil.

11. A method according to claim 10, further comprising mounting the ironing roll on a guide tube linearly movable toward and away from the coil, and mounting the guide tube on a pivoted frame, and, as the diameter of the coil increases, moving the guide tube and associated ironing roll linearly away from the coil and pivoting the frame so that, as the cam moves in the cam track, the ironing roll follows a curved path similar to and adjacent the locus of travel of the tangent point.

* * * * *